US005106236A

United States Patent [19]

Hancock et al.

[11] Patent Number: 5,106,236

[45] Date of Patent: * Apr. 21, 1992

[54] AUDIBLE ALARM DEVICE FOR DIVERS AND OTHERS

[76] Inventors: David A. Hancock, 5647-40th West, Seattle, Wash. 98199; Barry A. Kornett, Town House Moto-Azabu 401, 5-24 Moto-Azabu, Minato-Ku, Tokyo 106, Japan

[ * ] Notice: The portion of the term of this patent subsequent to Aug. 21, 2007 has been disclaimed.

[21] Appl. No.: 568,833

[22] Filed: Aug. 17, 1990

Related U.S. Application Data

[63] Continuation-in-part of Ser. No. 256,606, Oct. 12, 1988, Pat. No. 4,950,107.

[51] Int. Cl.[5] ..... B63C 11/02

[52] U.S. Cl. ..... 405/186; 116/27; 116/142 FP; 441/89

[58] Field of Search ..... 405/185, 186, 187; 116/26, 27, 112, 113, 142 FP; 441/80, 88, 89

[56] References Cited

U.S. PATENT DOCUMENTS

| | | | |
|---|---|---|---|
| 2,238,759 | 4/1941 | Vestrem | 116/26 X |
| 3,149,752 | 9/1964 | Gagnan et al. | 116/112 X |
| 3,605,418 | 9/1971 | Levine | 405/186 |
| 3,785,335 | 1/1974 | Wagner | 116/112 |
| 4,045,835 | 9/1977 | Flam et al. | 405/186 |
| 4,498,878 | 2/1985 | Shieh | 441/80 |
| 4,599,965 | 7/1986 | Johnson | 116/209 |
| 4,852,510 | 8/1989 | Joseph et al. | 405/186 X |
| 4,950,107 | 8/1990 | Hancock et al. | 405/186 |

*Primary Examiner*—David H. Corbin
*Attorney, Agent, or Firm*—Jensen & Puntigam

[57] ABSTRACT

An alarm apparatus, for use with conventional diving equipment or other self-contained breathing apparatus, having a body portion (34) and a noisemaker portion (32). The body portion (34) includes a first opening (42) therethrough communicating with a connection for a first hose (14) from an air tank. The body portion (34) includes another opening (50) in fluid communication with the first opening in which is positioned a guide element (68). A movable stem element (75) is positioned within said guide element (68). A bore (64) extends between the second opening (50) and the noisemaker portion (32) in which a horn bell (84) supported by a diaphragm (94) are positioned. A button (80) is connected to the stem element (75) and is biased in one position by a spring (82). Actuation of the button (80) results in fluid communication between the first opening (42) in the body portion (34) and the noisemaker portion (32), further resulting in an audible alarm.

6 Claims, 4 Drawing Sheets

AUDIBLE ALARM DEVICE FOR DIVERS AND OTHERS

This is a continuation-in-part of Ser. No. 256,606, filed on Oct. 12, 1988, now U.S. Pat. No. 4,980,107 titled Audible Alarm Device for Divers, in the names of David Hancock and Barry Kornett.

TECHNICAL FIELD

This invention relates generally to signaling equipment for use with self-contained breathing apparatus, such as used by divers, and more specifically concerns an audible alarm device for use therewith.

BACKGROUND ART

It is well recognized that divers, particularly divers using scuba-type equipment, should carry a signaling device of some kind. Such signaling devices are typically used to gain the attention of another party, including other divers, at the surface of the water. In many cases, the circumstances in which such signaling devices are used are non-emergency; however, occasionally emergencies do arise in which it is imperative that the attention of another party be obtained. This may include life threatening situations, in which if the assistance or attention of another party is not obtained, the death or serious injury of the diver results.

Thus, signaling devices are an important part of a diver's equipment. However, such signaling devices have in the past typically been limited to visual signaling devices such as shown in the U.S. Pat. No. 4,498,878 to Shieh, and U.S. Pat. No. 4,599,965 to Johnson. Such visual devices, however, are often not very effective in obtaining the desired attention, particularly if the other party is not looking in the general direction of the signaling device. Further, the known visual signaling devices are all rather bulky and cumbersome to use, which discourages a diver from carrying them.

The above requirements are also applicable with respect to other applications involving the use of self-contained breathing apparatus, such as for fire fighters.

There are of course general purpose audio signaling devices, such as shown in U.S. Pat. No. 3,785,335 to Wagner, which discloses a conventional air horn operated by Freon gas. The Wagner device can also be activated by blowing into it. However, the air horn is cumbersome, and in any event will not function in a water environment, so that it is not useful to divers. Typically, audible warning devices for scuba divers have taken the form of a conventional whistle, which is attached by a cord or the like to the scuba equipment. While reasonably convenient, such a device requires the diver to blow into it, which action in a particular circumstance the diver may not be capable of accomplishing. Further, there is a significant limitation on the carrying power, i.e. distance, of the sound of such a whistle. Hence, there is a significant need in the art for a signaling device which is both convenient and practical to use, but which also is capable of attracting considerable attention with minimum effort by the diver, fire fighter and the like.

DISCLOSURE OF THE INVENTION

Accordingly, the invention is an apparatus for use with a self-contained breathing apparatus, including means responsive to air under pressure to produce an audible alarm, said audible alarm means including an audible alarm element, said alarm means being adapted to be carried on or about the person of the user of the apparatus during use thereof, without interfering with the use of the apparatus; and means for receiving air under pressure from a tank source thereof which is carried on or about the person of the user and selectively providing said air to said audible alarm element.

BEST MODE FOR CARRYING OUT THE INVENTION

Figure 1:
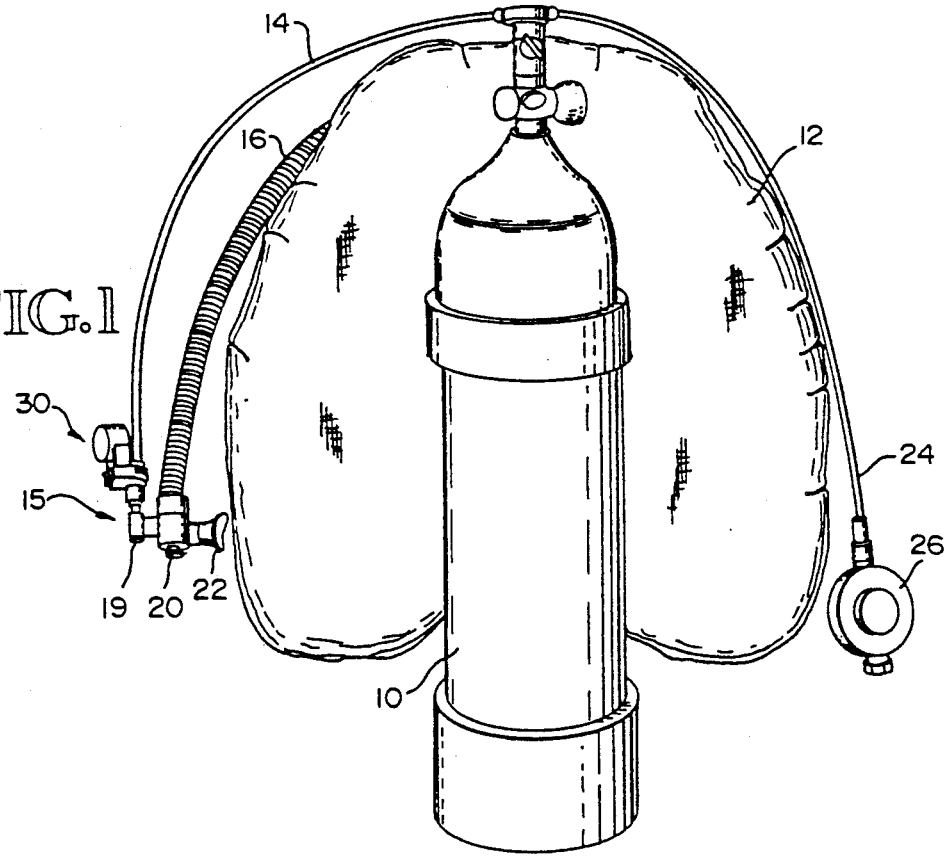
FIG. 1 is a environmental view showing the alarm apparatus of the present invention connected with conventional scuba diving equipment.

The present invention is a noise maker, i.e. an alarm device, which is specifically designed and arranged to be used as an integral part of conventional scuba diving equipment. Referring now to FIG. 1, certain elements of conventional scuba diving equipment are shown, including a scuba tank 10 containing compressed air and a buoyancy for the scuba diver. Inflation of the vest results in increased buoyancy, while deflation of the vest decreases buoyancy.

Conventionally, air from the tank 10 is provided through a low pressure hose 14 to an inflation/exhaust valve assembly 15 and from there through a corrugated inflation hose 16 to the buoyancy compensator vest 12. Conventionally, vest 12 is inflated with compressed air by actuation of an inflater button 19 associated with inflation/exhaust valve assembly 15, while air is released from the vest 12 by actuation of deflation button 20. In addition, vest 12 may be inflated orally by the diver through mouth piece 22. Another hose 24 is directed to a pressure regulator 26 and from there to the diver's mouth piece (not shown). The actual connection between the corrugated hose 16 and the vest 12 is not shown, although it is typically approximately in the middle of the vest 12.

Figure 2:
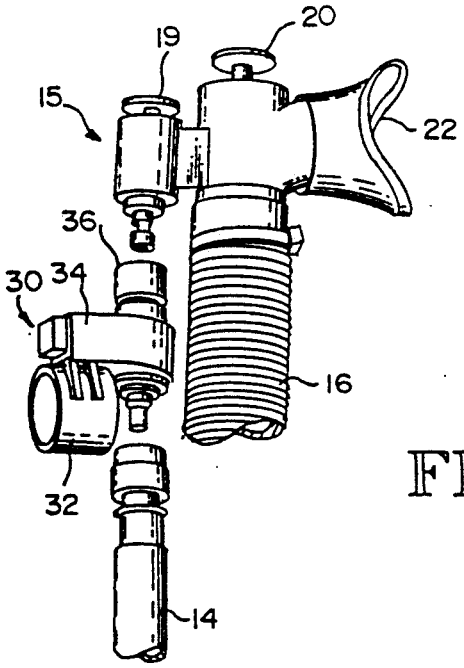
FIG. 2 is an environmental view showing a portion of the apparatus of FIG. 1.

Typically, quick connect/disconnect fittings are attached to the air hose 14 and the inflation/exhaust valve assembly 15, in the vicinity of the inflator button 19. The alarm apparatus of the present invention, shown generally at 30 in FIGS. 1 and 2, is connected between hose 14 and inflation/exhaust valve assembly 15. The alarm apparatus includes a noise maker portion 32 and a body portion 34, which includes a female connector 36, and a male connector 38, which in turn are connected by an interior passageway (not shown in FIG. 2). The female connector 38 is adapted for quick connect/disconnect with low pressure hose 14. Hence, the present invention is a noise maker which is adapted to be readily integrated with conventional scuba diving equipment, without any modification to the scuba equipment and without in any way interfering with its normal operation.

Figure 3:
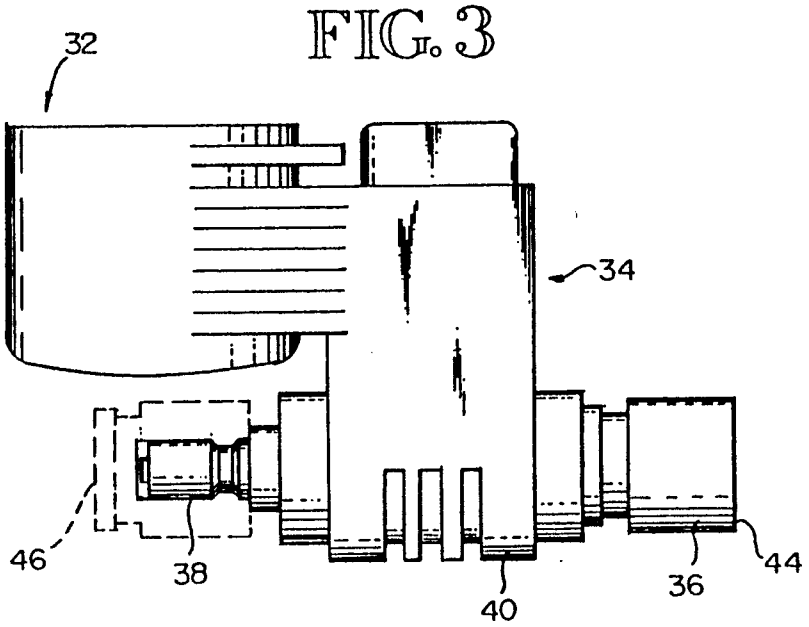
FIG. 3 is a side elevational view of the alarm apparatus of the present invention.
Figure 4:
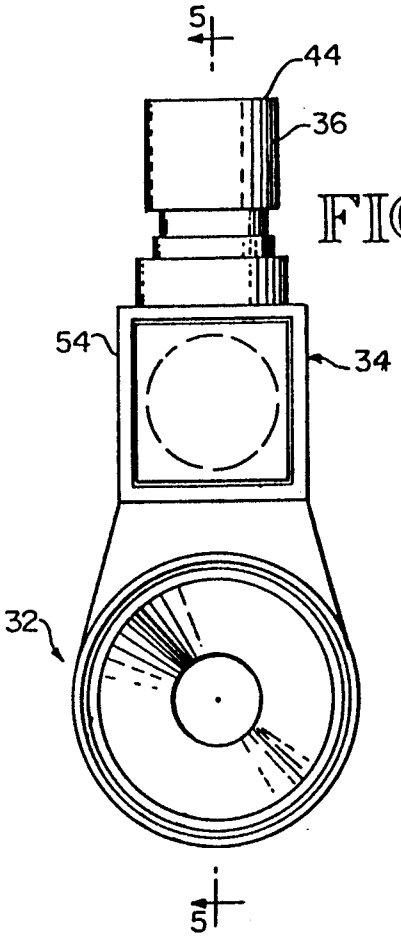
FIG. 4 is a top plan view of the apparatus of FIG. 3.
Figure 5:
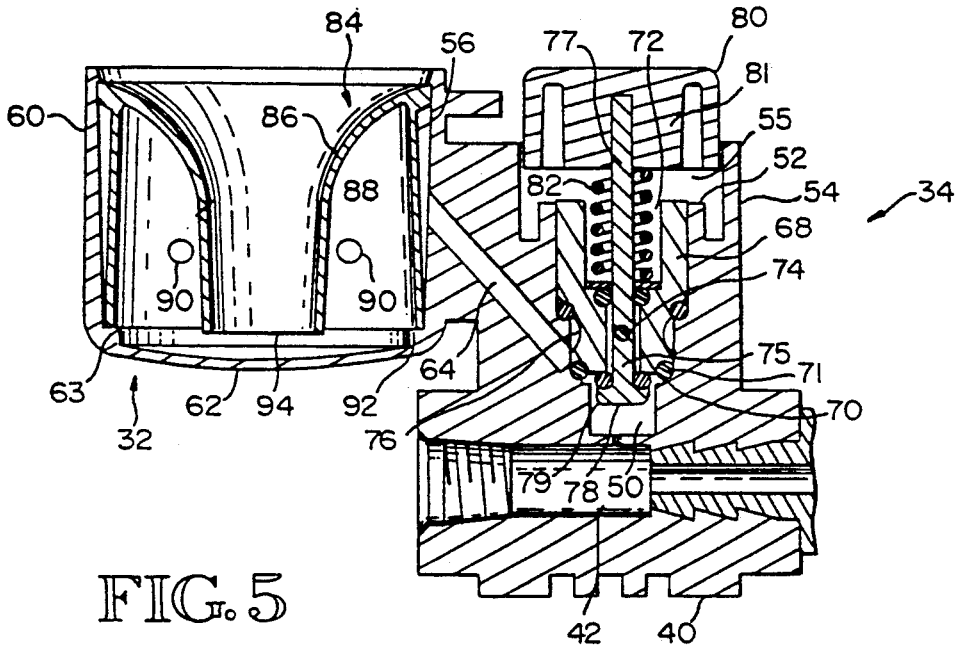
FIG. 5 is a cross sectional view of the apparatus of FIG. 3, taken along lines 6—6 in FIG. 4.

FIGS. 3–5 show the details of the alarm apparatus of the present invention. As disclosed briefly above, the alarm apparatus includes a noise maker portion 32 and a body portion 34, the body portion including a section 40 thereof which in turn includes a straight interior opening or passageway 42 which extends between female connector 36 at one end 44 (FIG. 1) which connects the alarm apparatus to low pressure hose 14 and a male connector 38 at the other end 46 which connects the alarm apparatus to the inflation/exhaust valve assembly 15.

In one operating mode or condition, compressed air is directed straight through the passageway 42 in body portion 34 from the low pressure hose 14 to the inflation/exhaust valve assembly 15. In this mode, the scuba equipment operates conventionally, in fact as if the alarm apparatus of the present invention was not present.

The body portion 34 also includes an internal opening 50 which extends from passageway 42 upwardly through body 34. The opening 50, which is circular in cross-section, increases in diameter from 0.1 inches at passageway 42 in three steps to a diameter of approximately 0.6 inches. The sides of opening 50 in the embodiment shown have a 1° inward draft. Bounding the top of opening 50 is a circular lip 52 which is approximately 0.11 inches high. Outward from lip 52 is a wall 54, which is configured to define a square volume 55, approximately 1 inch on a side.

The noisemaker portion 32 is a circular cup-like element which is integral with and extends from the body portion 34. Generally, the noisemaker 32 is positioned to the side of and extends somewhat above the position of the opening 50 in the body portion 34. The noisemaker 32 includes a cavity 56 which is defined by a circular peripheral wall 60 and a lower surface 62 which is slightly concave. In the embodiment shown, the peripheral wall has an internal diameter of approximately 1.4 inches, with a 1° inward draft from top to bottom, and is approximately 1.13 inches deep. There is a narrow peripheral lip 63 at the lower end of peripheral wall 60, with the concave lower surface 62 being immediately therebelow.

An angular bore 64 approximately 0.06 inches in diameter connects the lower part of opening 50 in body portion 34 with the noisemaker portion, at a point approximately mid-height of cavity 56.

Positioned within the opening 50 in the body 34 is a button stem guide 68. Generally, button stem guide 68 is configured to mate with the configuration of opening 50, and extends from the top of opening 50 to the middle step or lip 70 thereof. O-rings 71—71 are positioned at selected points around button stem guide 68 which provide a fluid-tight seal between the button stem guide 68 and the opening 50. Extending longitudinally completely through the button stem guide 68 is a central axial opening 72. Opening 72 includes an upper portion having a diameter of approximately 0.34 inches, a narrow lip immediately below the first portion which has a diameter of approximately 0.23 inches and a lower portion having a diameter of approximately 0.15 inches.

Extending through the wall of the button stem guide in the lower portion of the axial opening 72 is a lateral opening 74, approximately 0.08 inches in diameter, which connects the axial opening 72 with a peripheral groove 76 which extends around the exterior surface of the button stem guide near the bottom end thereof, at a point such that the end of bore 64 which opens into opening 50 is in registry therewith. There is thus a fluid-continuous passage between passageway 42, opening 50, axial opening 72, lateral opening 74, groove 76 and bore 64, leading to cavity 56 in noisemaker 32.

Positioned within the button stem guide 68 is an elongated button stem 75. Button stem 75 is in the form of a bolt which includes a shank 77, the upper free end of which is threaded, and a head 78. The diameter of the shank 77 is slightly less than the diameter of the lower portion of axial opening 72 in the button stem guide 68. The button stem is positioned such that the head 78 of the stem, which has a larger diameter than the lower portion of opening 72, is positioned below the lower surface of the button stem guide 68. An O-ring 79 is positioned beneath the head of the button stem 75 to provide a fluid tight seal between the button stem 75 and the button stem guide 68.

The upper free end of the button stem 75 is threaded into a square button 80 which in the embodiment shown is 0.82 inches on a side so that it fits into the square volume 55 defined by wall 54. The button 80 includes a central depending cylindrical portion 81 into which the button stem is threaded, and an outer square wall defining the outer surface of the button, leaving a space between the cylindrical portion and the wall.

A spring 82 is positioned around a portion of the button stem 75, between the lower surface of the cylindrical portion 81 of button 80 and the narrow lip defined in the axial opening 72 of button stem guide 68. A washer and O-ring are positioned beneath the spring 82, for fluid tight operation and reliable movement of the button stem within the button stem guide 68.

When the button 80 is depressed, compressing the spring 82, the head 78 of the button stem 75 moves downwardly, away from the lower surface of button stem guide 68, permitting compressed air to move from passageway 42 around the button stem and into the opening 72 in button stem guide 68 and from there through lateral opening 74 in the button stem guide, into and around peripheral groove 76, and through bore 64 to the noisemaker portion 32. When the button 80 is in its raised position, which is its biased position established by the spring 82, the head 78 of the button stem 75 is firmly positioned against the lower surface of button stem guide 68. The O-ring 79 beneath the head 78 prevents any fluid, i.e. compressed air, from reaching the axial opening 72 of the button stem guide 68. Hence, no compressed sir reaches the noisemaker.

Positioned within the noisemaker 32 is a horn bell element 84. The horn bell 84 includes a curved inner peripheral circular wall 86 which has a diameter of approximately 1.42 inches at its upper end, and which then curves inwardly therefrom with a radius of 0.36 inches to a diameter of 0.44 inches, and then downwardly therefrom with a slight inward taper. The overall height of the inner peripheral wall 86 is 1.05 inches. Extending downwardly from the upper edge of inner peripheral wall 86 is an outer peripheral wall 88. The outer peripheral wall 88 extends downwardly and terminates slightly above (0.03 inches in the embodiment shown) inner peripheral wall 86. The diameter at the top of the outer peripheral wall 88 is 1.32 inches, and tapers outwardly with a 2° draft in the embodiment shown. Four openings 90–90 are positioned at spaced intervals in the outer peripheral wall 88. In the embodiment shown the openings 90 are approximately 0.1 inches in diameter, and are located approximately 0.68 inches from the top end of the horn bell.

The horn bell is positioned within the cup-like cavity 56 of the noisemaker, with the upper edge of inner peripheral wall 86 positioned against the inner surface of peripheral wall 60 of the noisemaker, and with the lower edge 92 of outer peripheral wall 88 being supported by peripheral lip 63. A thin diaphragm 94 is also supported by the peripheral lip 63, positioned between lip 63 and the lower edge 92 of the outer peripheral wall of the horn bell. The lower edge of the inner peripheral wall 86 of the horn bell also is in contact with the upper surface of the diaphragm 94. Since the inner peripheral wall 86 extends slightly below outer peripheral wall 88, the diaphragm 94 is slightly concave in the embodiment shown.

In normal operation, the spring 82 biases the button 80 and hence the button stem 75 in their uppermost position, such that no air is permitted into the axial opening 72 of button stem guide 68 and hence there is no movement of air into the noisemaker 32. The movement of air is thus straight through the body portion 34, directly between the low pressure hose 14 and the corrugated hose 16 connections.

However, when an alarm is to be made by the diver, alerting third parties, the button 80 is depressed, thereby depressing button stem 75, such that the head portion 78 of button stem 75 is free of the lower surface of button stem guide 68, permitting compressed air to move from passageway 42 into the opening 50, then through axial opening 72 and lateral opening 74 and then through groove 76 and finally through bore 64 into the cavity 56 of noisemaker 32. This rush of air operates on the horn bell 84, which in response produces a very loud noise, attracting the desired attention of a third party.

Accordingly, an invention has been described which is capable of producing a loud noise, but which is adapted for integration into conventional scuba diving equipment. The resulting combination is practical and easy to use, and does not otherwise interfere with the operation of the diving equipment or the actions of the diver.

Figure 6:
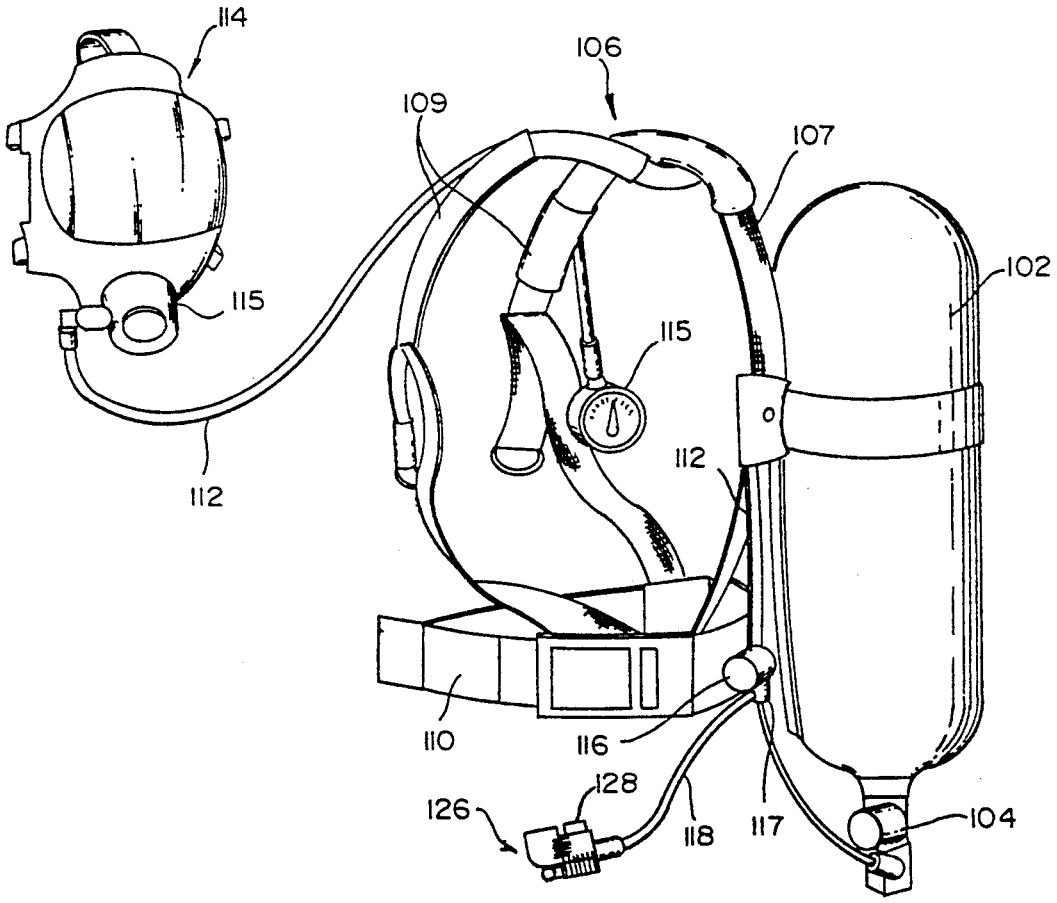
FIG. 6 is a schematic view showing the alarm apparatus of the present invention as part of a self-contained breathing apparatus such as used by fire fighters.

FIG. 6 shows an alternative embodiment to that shown in FIG. 1. The embodiment of FIG. 6, like the embodiment of FIG. 1, includes a tank of compressed air which is carried upon the person of the user of the apparatus. However, instead of the user being a diver and the apparatus being used under water, the apparatus shown in FIG. 6 is intended for use by fire fighters and personnel dealing with hazardous material or in other situations where a self-contained breathing apparatus is necessary.

While the embodiment of FIG. 6 thus is used in a slightly different context than diving, the basic purpose and operation of the apparatus remains the same. Specifically, the apparatus must provide a reliable, loud, audible signal, be simple to operate and should not interfere with the actions of the user.

The apparatus of FIG. 6 includes a conventional tank of compressed air 102 and a conventional valve regulator 104 at the outlet of tank 102. The compressed air tank with its attached regulator is carried by the user by means of a conventional harness arrangement shown generally at 106, in combination with a metal packframe 107. The harness 106 includes adjustable straps 109 which connect to the packframe 107, go over the shoulders of the user, and connect to a belt 110 which is secured around the waist of the user.

An air hose 112 extends from the regulator 104 through the harness to a face mask 114. The face mask is conventional and is selected for the particular environment in which the equipment is being used. For fire fighters, for instance, the mask 114 will be like that shown in FIG. 6, covering the face of the user in an air-tight relationship and held on by elastic straps or the like. At the mouthpiece of the mask 114 is a conventional demand valve 115. The face mask 114 could, however, be a full helmet or similar device, depending on the particular use of the apparatus. The apparatus of FIG. 6 also includes a conventional pressure gauge 115, which indicates the amount of compressed air left in the tank 102.

Located part way along the air hose 112, typically about 12 inches or so from the tank 102, is a conventional pressure reducing element 116, which includes a pressure relief valve. Fitted to the pressure relief valve is a fitting 117 for a pigtail hose 118, which is approximately 12 inches long. Alternatively, element 116 could be a conventional T-fitting for the pigtail hose 118. The pigtail 118 is typically secured to the belt of the harness. The pigtail is typically used as a connection to a remote air source or used for "buddy breathing" with another similar apparatus.

In the embodiment of FIG. 6, the alarm apparatus shown in detail in FIGS. 3–5 is connected to the free end of pigtail hose 118, as shown at 126. The connector element 36 shown in FIG. 3 is adapted for a quick connect/disconnect relationship with the mating coupling on the free end of pigtail hose 118. The coupling action of the alarm apparatus with the pigtail 118 results in compressed air being available to the alarm apparatus. The coupling element 38 shown in FIG. 3 blocks any flow-through of compressed air. The coupling element 38 is similar to the coupling element on the free end of pigtail 118, permitting conventional use of the pigtail through the alarm apparatus 126, as the need arises.

In operation, the operator depresses button 128 on the alarm apparatus 126, and compressed air from tank 102 is fed through the alarm apparatus, producing a very loud noise designed to bring attention to the user.

Hence, the apparatus of the present invention may be used with diving apparatus such as described above with respect to Figure or with a more generalized self-contained breathing system, such as used by fire fighters, hazardous waste personnel, and in other similar situations, as shown in FIG. 6.

Although a preferred embodiment of the invention has been disclosed herein for illustration, it should be understood that various changes, modifications and substitutions may be incorporated in such embodiment without departing from the spirit of the invention as defined by the claims which follow. It should be understood, for instance, that the structure of the present invention could be made integral with an inflation/exhaust valve assembly, i.e. assembly 15 in FIG. 2.

We claim:

1. An apparatus for use with a self-contained breathing apparatus to produce an audible alarm, comprising:

means responsive to air under pressure to produce an audible alarm, said audible alarm means including an audible alarm element, said alarm means being adapted to be carried on or about the person of the user of the apparatus during use thereof, without interfering with the use of the apparatus; and means for receiving air under pressure from a tank source thereof which is carried on or about the person of the user and selectively providing said air to said audible alarm element, said air receiving means including means for bypassing said audible alarm element with said air when said air is not to be provided to said audible alarm element.

2. An apparatus of claim 1, wherein said air receiving means and said audible alarm element are an integral part of said audible alarm means.

3. An apparatus of claim 2, wherein said audible alarm element includes a cavity which includes therein a horn bell insert supported on a thing diaphragm which in turn is supported on a lower peripheral lip of the cavity.

4. An apparatus of claim 3, wherein said air receiving means includes a body portion having an opening in fluid communication with the tank source of air, said opening being in fluid communication with said cavity via a bore-like passageway, wherein said apparatus includes means positioned in said opening operable between two positions, wherein in one position fluid communication between said opening and said bore-like passageway is prevented and in the other position fluid communication is permitted, resulting in the audible alarm.

5. An apparatus of claim 4, wherein the means positioned in said opening includes an insert having a fluid-tight relationship with the body portion, the insert having a central axial opening and an elongated stem-like element movably positioned within the central axial opening, the insert further including a peripheral groove around the exterior surface thereof, the groove being in fluid communication with said bore-like passageway, said insert also including a lateral opening which extends between the central axial opening of said insert and the peripheral groove thereof, the apparatus further including a button element connected to the stem-like element in a first position in which a head portion of the stem-like element closes off the central axial opening of the insert, the stem-like element being further arranged relative to the spring that when the button is depressed, the stem-like element moves away from the central opening of the insert, permitting fluid to move thereinto.

6. A self-contained breathing apparatus which includes an audible alarm apparatus, comprising:

a tank source of pressurized air adapted to be carried on the person of a user;

breathing apparatus adapted for air-tight placement around the face of the user;

air control and air hose means connecting the tank to the breathing apparatus for controlled provision of air thereto and hence to the user; and audible alarm means, including an audible alarm element, responsive to air under pressure from said tank to produce an audible alarm, said audible alarm means being adapted to be carried on or about the person of the user of the self-contained breathing apparatus, without interfering with the use of the apparatus, the alarm means further including means for receiving air under pressure from the tank and selectively providing said air to said alarm element, said air receiving means including means for bypassing said audible alarm element with said air when said air is not to be provided to said audible alarm element.

* * * * *

UNITED STATES PATENT AND TRADEMARK OFFICE

CERTIFICATE OF CORRECTION

PATENT NO. : 5,106,236

DATED : April 21, 1992

INVENTOR(S) : David A. Hancock and Barry A. Kornett

It is certified that error appears in the above-identified patent and that said Letters Patent is hereby corrected as shown below:

Col. 7, claim 3, line 8, "thing" should be --thin--.

Signed and Sealed this

Fourteenth Day of September, 1993

Bruce Lehman

*Attest:*

BRUCE LEHMAN

*Attesting Officer*

*Commissioner of Patents and Trademarks*